US006363530B1

(12) United States Patent
Lampson et al.

(10) Patent No.: US 6,363,530 B1
(45) **Date of Patent: *Apr. 2, 2002**

(54) DISPOSABLE BIB

(75) Inventors: Patricia Lee Lampson; Amit Gupta, both of Cincinnati; Beverly Ann Julian Jackson, Hamilton; Richard Nicholas Reinhart, Jr., Cincinnati; Robert Drennan Lewis, Hamilton; Nicholas Albert Ahr, Cincinnati, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/948,572

(22) Filed: Oct. 10, 1997

Related U.S. Application Data

(60) Provisional application No. 60/030,100, filed on Oct. 31, 1996, and provisional application No. 60/034,674, filed on Jan. 10, 1997.

(51) Int. Cl.[7] ..... A41B 13/00

(52) U.S. Cl. ..... 2/49.1; 2/49.2; 2/49.4

(58) Field of Search ..... 2/48, 49.1, 49.2, 2/49.4, 49.5, 50, 51, 52

(56) References Cited

U.S. PATENT DOCUMENTS

| | | | | |
|---|---|---|---|---|
| 1,980,436 A | | 11/1934 | Reagan | 2/49 |
| 3,286,279 A | | 11/1966 | Brown | 2/19 |
| 3,329,969 A | | 7/1967 | Farber et al. | 2/49 |
| 3,608,092 A | | 9/1971 | Taranto | 2/49 R |
| 3,654,629 A | | 4/1972 | Crisman et al. | 2/49 |
| 3,916,447 A | | 11/1975 | Thompson | 2/46 |
| 3,979,776 A | | 9/1976 | Gruenwald | 2/49 R |
| 4,107,364 A | | 8/1978 | Sisson | 428/196 |
| 4,186,443 A | | 2/1980 | Britzman | 2/49 R |
| 4,416,025 A | | 11/1983 | Moret et al. | 2/49 R |
| 4,441,212 A | | 4/1984 | Ahr et al. | 2/49 R |
| 4,445,231 A | | 5/1984 | Noel | 2/49 R |
| 4,495,658 A | | 1/1985 | Moret et al. | 2/49 R |
| 4,523,333 A | | 6/1985 | Spangler | 2/49 R |
| 4,523,334 A | | 6/1985 | Lavash | 2/49 R |
| 4,646,365 A | | 3/1987 | Suprise et al. | 2/49 R |
| 4,797,952 A | | 1/1989 | Petrini | 2/49 R |
| 4,834,741 A | | 5/1989 | Sabee | 604/385.2 |
| 4,846,822 A | | 7/1989 | Foxman | 604/370 |
| 4,884,299 A | * | 12/1989 | Rose | |
| 5,074,013 A | | 12/1991 | Arnold et al. | 24/713 |
| 5,143,679 A | | 9/1992 | Weber et al. | 264/288.8 |
| 5,156,793 A | | 10/1992 | Buell et al. | 264/288.8 |
| 5,167,897 A | | 12/1992 | Weber et al. | 264/288.8 |
| 5,518,801 A | | 5/1996 | Chappell et al. | 428/152 |
| 5,620,430 A | | 4/1997 | Bamber | 604/385.2 |
| 5,650,214 A | | 7/1997 | Anderson et al. | 428/152 |
| 5,672,056 A | | 9/1997 | Fisher et al. | 433/137 |

FOREIGN PATENT DOCUMENTS

| | | | |
|---|---|---|---|
| BE | 563865 | 6/1960 | |
| FR | 2 430 203 | 2/1980 | A41B/13/10 |

* cited by examiner

*Primary Examiner*—John J. Calvert
*Assistant Examiner*—Shirra L. Jenkins
(74) *Attorney, Agent, or Firm*—Jay A. Krebs; Ken K. Patel

(57) ABSTRACT

A bib having one or more portions which are permanently elongated. The bib can include a strainable network. The network can be formed in a laminate of a paper layer and a plastic film layer. The strainable network can have at least two visually distinct regions. The strainable network can provide improved flexibility and fit of the bib against the wearer.

26 Claims, 8 Drawing Sheets

DISPOSABLE BIB

Priority is claimed to the following provisional patent applications: Provisional Application Serial No. 60/030,100 "Bib Having a Strainable Network" filed Oct. 31, 1996 and Provisional Application Serial No. 60/034,674 "Disposable Bib Having a Strainable Network" filed Jan. 10, 1997.

FIELD OF THE INVENTION

The present invention is related to disposable bibs, and more particularly, to a bib formed to have extensible portions.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

One problem with laminate structures is that laminate structures can be relatively stiff. A relatively stiff bib can be uncomfortable to wear. A relatively stiff bib can also gap away from the wearer's body, thereby leaving the wearer's skin or clothing exposed. A bib that is relatively flexible can be more easily adapted to fit closely against the wearer's body. It can also be advantageous to make at least a portion of the bib elastically extensible to enhance fit against the wearer.

Accordingly, it is an object of the present invention to provide a disposable bib having a laminate structure.

Another object of the present invention is to provide a disposable bib which is relatively flexible in order to enhance fit of the bib against the wearer's body.

Another object of the present invention is to provide a disposable bib which is extensible along at least one axis, such as along the longitudinal or lateral axis of the bib.

SUMMARY OF THE INVENTION

The present invention provides a disposable bib, wherein at least one portion of the bib is permanently elongated such that the portion of the bib is stretched beyond its elastic limit.

Such permanent elongation can provide improved extensibility and flexibility of the portion of the bib along at least one direction during subsequently applied loading, and can provide increased Z-direction bulking of the bib.

In one embodiment, the bib comprises a strainable network. The strainable network includes a first region and a second region. The first region undergoes a substantially molecular level deformation and the second region initially undergoes a substantially geometric deformation when the laminate is subjected to an applied elongation along at least one axis. The first region and the second region are visually distinct from one another. The second region can include a plurality of rib like elements.

The bib can comprise a laminate of a first layer and a second layer. In one embodiment, the laminate comprises a first tissue paper layer and second body facing layer. The second body facing layer can comprise a liquid impervious polymeric film. The raised rib like elements extend outwardly from the body facing layer. The strainable network can be oriented to provide elastic like behavior of the laminate along one or more axis, such as in a lateral direction, or alternatively, in a longitudinal direction parallel to the bib longitudinal axis.

In one embodiment, the strainable network comprises a plurality of first regions and a plurality of second regions. A portion of the first regions extend in a first direction, while at least some of the other first regions extend in a second direction different from the first direction. A portion of the first regions can extend in a first direction, and the remainder of the first regions can extend in a second direction which is substantially perpendicular to the first direction to provide intersecting first regions. The intersecting first regions form a boundary completely surrounding the second regions.

The intersecting first regions can extend in first and second directions which are mutually perpendicular. The first and second directions can be inclined at an angle of between about 30 and about 60 degrees relative to the longitudinal centerline of the disposable bib. The rib-like elements of the second regions can have a major axis which extends substantially perpendicular to the longitudinal centerline of the bib.

The bib can also comprise a pocket having pocket panel, and an apron panel depending from the pocket open edge. A portion of one or both of the pocket panel and the apron panel can comprise a strainable network.

In another embodiment, at least a portion of the bib is ring rolled to provide permanent elongation and improved extensibility and flexibility along at least one direction.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
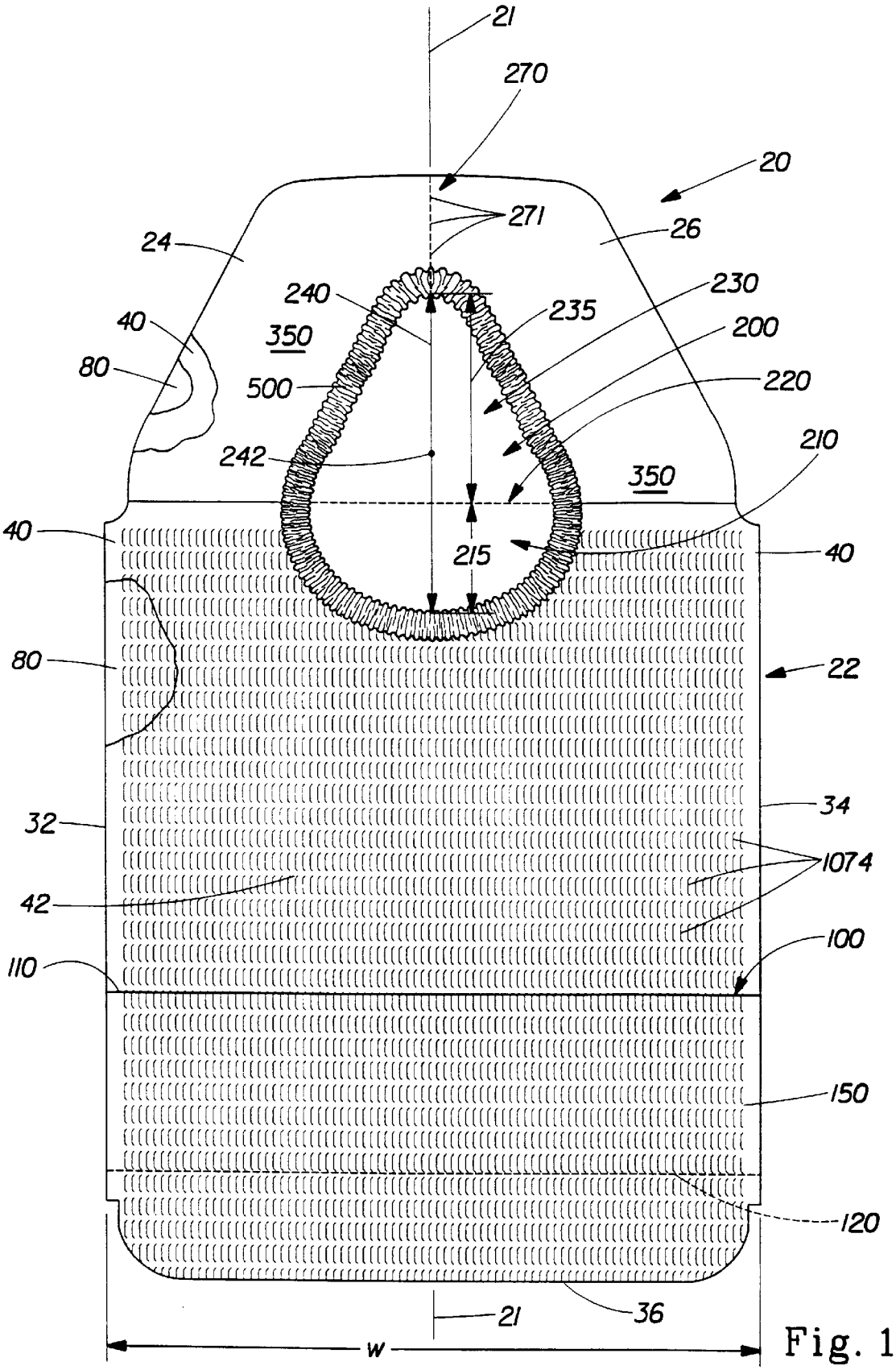
FIG. 1 is a schematic illustration of a front plan view of the disposable bib of the present invention wherein the bib is supported in a flat, generally planar orientation.

FIGS. 1–4 illustrate a disposable bib 20 according to one embodiment of the present invention.

The present invention provides a disposable bib 20, wherein at least one portion of the bib 20 is permanently elongated to provide improved extensibility of that portion of the bib during subsequently applied loading, such as subsequently applied forces and/or elongations.

By "permanently elongated" it is meant that a portion of the bib is stretched beyond its elastic limit, and that upon removal of the mechanism causing the stretching, the portion of the bib retains a deformed configuration having a length which is greater than the corresponding initial length of that portion of the bib prior to stretching.

By "improved extensibility" it is meant that the portion which has been previously permanently elongated in a direction contrary to a plane of the bib, has the characteristic that it extends (or lengthens) in the plane of the bib, under a subsequently applied load in the plane of the bib, to a greater degree than the portion would extend if the same level of loading were applied to the portion of the bib prior to the portion of the bib being permanently elongated. The plane of the bib is parallel to the plane of FIG. 1.

In particular, the bib can include selected portions which have been permanently elongated to be more extensible than other portions of the bib which have not been permanently elongated.

The bib can include a laminate of at least a first layer and a second layer, and portions of the laminate can be permanently elongated. In addition to providing extensiblity, the permanently elongated portions result in Z-direction bulking of the bib (the Z-direction is perpendicular to the plane of FIG. 1), such that surfaces of the bib have texture in the form relatively raised regions and relatively recessed regions, such as in the form of corrugations, rib-like elements, peaks and valleys, and the like.

Further, such texture and Z-direction bulking is provided without the use of elastic elements or elastic gathering methods. Such surface texture can be useful in slowing the travel of spilled materials dropped on the bib, thereby aiding in the absorption of the spilled material by the bib.

Referring to FIGS. 1–4, the bib 20 comprises a bib body 22 having longitudinally extending sides 32 and 34, a longitudinal length, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

The bib can comprise a laminate of at least two layers. Referring to FIG. 1, the bib body 22 comprises a laminate construction. The laminate includes a first paper layer 40 and a second plastic film layer 80. In FIG. 1, a portion of the paper layer 40 is shown cut away to reveal the plastic film layer 80. The outer surface 42 of the paper layer 40 faces the viewer in FIG. 1. The body facing surface 82 of the second plastic film layer 80 faces the viewer in FIG. 2.

Figure 3:
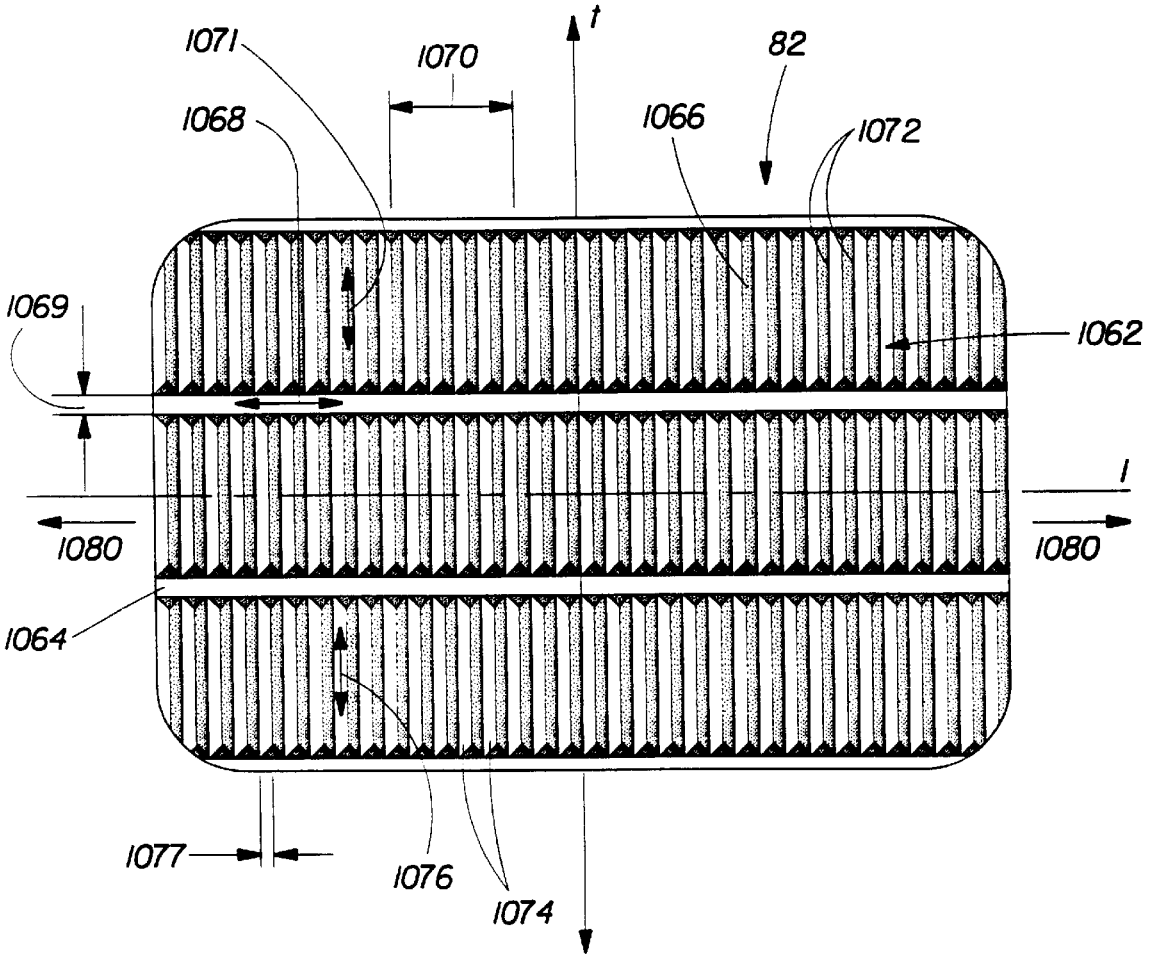
FIG. 3 is enlarged view of a portion of the body facing side of the bib shown in FIG. 2, showing detail of the strainable network as viewed in FIG. 2.

In the embodiment shown in FIG. 1, at least a portion of the laminate of the first layer 40 and the second layer 80 is permanently elongated to provide a strainable network. An enlarged view of the strainable network is shown in FIG. 3. Such a strainable network is disclosed in U.S. Pat. No. 5,518,801 issued May 21, 1996 to Chappell et al., which patent is incorporated by reference herein. The strainable network provides elastic like behavior of the laminate along at least one axis, as disclosed in above referenced U.S. Pat. No. 5,518,801. The strainable network can be formed by permanently elongating portions of the bib using the apparatus shown in FIGS. 7–9, as described more fully below.

The term "strainable network" refers to an interconnected and interrelated group of regions which are able to be extended to some useful degree in a predetermined direction for providing a component with an elastic-like behavior.

The strainable network includes one or more first regions and one or more second regions. The first regions can undergo a substantially molecular level deformation, or a combination of molecular level deformation and geometric deformation in response to an subsequently applied elongation, such as an elongation applied to the bib once the strainable network is formed. The second regions initially undergo a substantially geometric deformation in response to a subsequently applied elongation, such as an elongation applied to the bib once the strainable network is formed.

The term "molecular level deformation" refers to deformation which occurs on a molecular level and is not discernible to the normal naked eye, such that even though one may be able to discern the effect of the molecular level deformation (e.g. elongation of a component), one is not able to discern the deformation which allows or causes the elongation. This is in contrast to "geometric deformation". The term "geometric deformation" refers to deformations which are discernible to the normal naked eye. "Geometric deformation" includes, but is not limited to, bending, unfolding, and rotating.

The bib 20 can also comprise a pair of shoulder extensions 24, 26. The shoulder extensions 24, 26 extend from the bib body 22 from their proximal ends to their distal ends to provide a generally planar neck opening 200 when the bib is supported on a flat, horizontal surface.

The generally planar neck opening 200 has a front neck portion 210, a rear neck portion 230, and a maximum width portion 220 disposed intermediate the front neck portion 210 and the rear neck portion 230. The neck opening 200 also has a longitudinal length 240 measured along the longitudinal centerline 21. The maximum width portion 220 of the opening 200 can be a line of maximum width, as shown in FIG. 1, and is disposed between the front neck portion 210 and the rear neck portion 230. The longitudinal length 215 of the front neck opening portion 210 is less than the longitudinal length 235 of the rear neck portion 230. The longitudinal length 235 can be at least 1.5 times the length 215, and more preferably at least 2.0 times the length 215.

The generally planar neck opening 200 is generally symmetric about a longitudinal axis, such as the longitudinal centerline 21, and is generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

Figure 4:
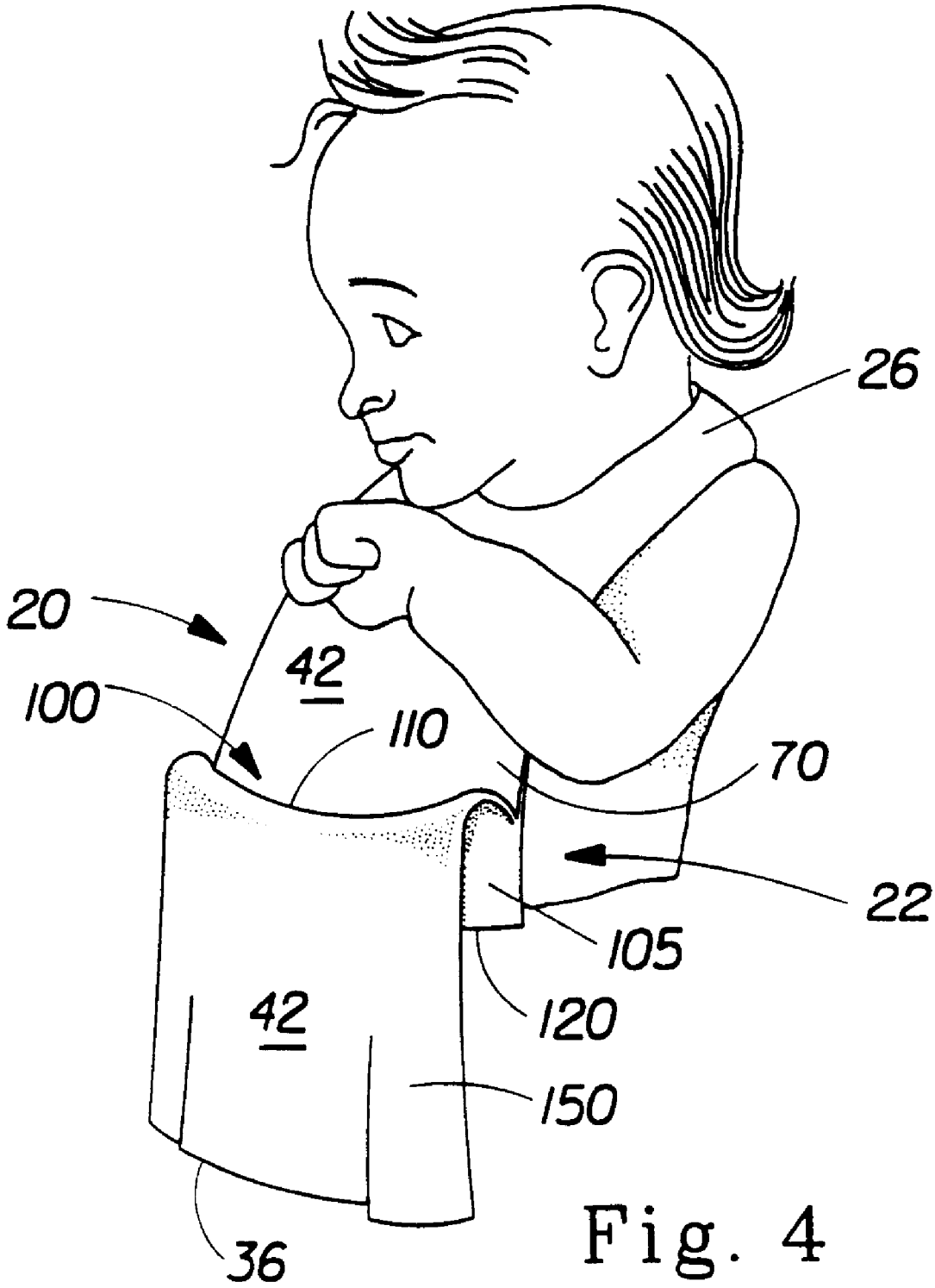
FIG. 4 is an in use perspective view of a disposable bib according to the present invention.

The bib 20 can also include a pocket 100 extending substantially the full lateral width of the bib 20 for catching and receiving food particles. Referring to FIG. 4, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body.

The body panel 70 is disposed adjacent the wearer's body when the bib is secured to the wearer. The pocket panel 105 can have a generally rectangular shape, and is disposed adjacent the body panel 70 to form a pocket space intermediate the body panel and the pocket panel. The pocket panel 105 extends longitudinally from a pocket bottom edge 120 to a pocket open edge 110, and the pocket panel 105 extends laterally intermediate the bib side edges 32 and 34. The bottom edge 120 and the open edge 110 can both be substantially perpendicular to the longitudinal centerline 21 and substantially parallel to an imaginary lateral axis.

The apron panel 150 can extend from the pocket open edge 110 to the bib bottom edge 36. The apron panel 150 can depend in a pendulous fashion from the pocket open edge 110 to provide gravitational opening of the pocket 100. The body panel 70, pocket panel 105, and apron panel 150 can be formed from a continuous sheet of material, the sheet of material comprising one or more laminae. U.S. Pat. No. 4,445,231 "Bib Having Gravitationally Openable Pocket" issued May 1, 1984 to Noel is incorporated herein by reference for the purpose of showing a bib construction for forming a bib having a pocket and an apron panel.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array 305 of projections 312 extending from a portion of the shoulder extension 26. The projections 312 are engagable with a landing surface, the landing surface being disposed on at least a portion of the shoulder extension 24.

In one embodiment, the projections 312 can comprise prongs, and the landing surface can comprise a target surface 350 of a nonwoven web disposed on at least a portion of the shoulder extension 24. The nonwoven web having the surface 350 can be adhesively joined to the paper layer 40 on the shoulder extensions 24 and 26. A nonwoven web disposed on both the shoulder extensions 24, 26 can provide a soft, nonabrasive surface about the wearer's neck.

The neck opening 200 can comprise a relatively thick, gathered border 500. The border 500 is thicker than the adjacent portions of the shoulder extensions 24 and 26 (Thicker than the combined thicknesses of the layer 40, the layer 80, and the nonwoven web having surface 350). The border 500 can extend outward from the surface 350, as viewed in FIG. 1. Similarly, the border 500 can extend outward from the surface 82, as viewed in FIG. 2. The thicker, gathered border 500 permits a close yet comfortable fit of the bib about the wearer's neck.

Referring to the components of the bib 20 in more detail, the bib 20 according to one embodiment of the present invention comprises a composite construction having multiple laminae. The bib 20 comprises a laminate of a first layer, such as an absorbent outer topsheet layer 40, and a second layer, such as a body facing backsheet layer 80 which is liquid impermeable relative to the topsheet 40. The topsheet 40 has an outer surface 42 for receiving spilled food material. The backsheet 80 has a body facing surface 82 shown in FIG. 2. The layer 40 and the layer 80 can be joined together, such as with an adhesive, to form a laminate. In one embodiment, the shoulder extensions 24, 26, the bib body panel 70, the pocket panel 105, and the apron panel 150 are formed from a single, continuous sheet of the laminate of the topsheet 40 and the backsheet 80.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat. Nos. 4,191,609; 4,529,480; 4,637,859; 5,223,096; and 5,240,562. A suitable topsheet 40 can be formed from a single ply or multiple ply paper towel. In one embodiment, the topsheet 40 comprises a two ply Bounty paper towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.3 mil and about 4.0 mil (about 0.0003 inch to about 0.0040 inch). In one embodiment the backsheet can comprise a FS-II embossed Polyethylene film having a thickness of about 2.0 mil and manufactured under the designation CPC-2 by Tredegar Film Products of Cincinnati, Ohio.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. Suitable adhesives include HL-1258 and HL 1262 adhesives manufactured by H.B. Fuller Co. of St. Paul, Minn.

The target surface 350 can comprise the surface of a nonwoven web of fibers disposed on at least a portion of the shoulder extensions 24 and 26 to cover an upper portion of the surface 42 of topsheet 40. In the embodiment shown in FIG. 1, the target surface 350 extends over the majority of the outer surface of the shoulder extensions 24 and 26. A suitable nonwoven web is manufactured by the Fiberweb Corp. of Simpsonville, S.C. under the designation Celestra Unicorn.

Alternatively, such a nonwoven web can extend over substantially all of the paper layer 40 such that the shoulder extensions 24, 26, the bib body panel 70, the pocket panel 105, and the apron panel 150 are formed from a single, continuous sheet of a laminate of at least three layers: the backsheet 80, the paper layer 40, and the nonwoven web, with the paper layer 40 disposed between the backsheet 80 and the nonwoven web.

The ruffled border 500 of the neck opening 200 can comprise a laminate of a nonwoven material and an elastically extensible material. The elastically extensible material can be joined to the nonwoven material to gather the nonwoven material. One suitable elastically extensible material is a DUPONT LYCRA material. Once the laminate of the nonwoven and elastically extensible material is formed, the laminate can be joined to the perimeter of the opening by any suitable means, such as by adhesive bonding.

Prior to the time the bib is to be used, the shoulder extensions 24 and 26 can be joined together, such as at their distal ends, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 can extend partially or fully through the thickness of the bib 20. The perforations can be formed with a perforating knife, and can extend through each of the backsheet 80, topsheet 40, and nonwoven web.

The body panel 70, pocket panel 105 and apron panel 150 can be formed from a continuous web comprising a laminate of at least two layers, such as the layers 40 and 80, or optionally at least three layers, such as a nonwoven web and layers 40 and 80. The teachings of above referenced U.S. Pat. No. 5,518,801 can be used to permanently elongate portions of the bib 20 and impart a strainable network to selective portions of one or more of the panels 70, 105, and 150. The strainable network is shown covering a portion of the bib 20 in FIGS. 1 and 2, and is shown enlarged in FIG. 3. The portion of the strainable network shown in FIG. 3 is viewed from surface 82 and is designated generally as 1062.

Referring to FIG. 3, the strainable network 1062 includes a plurality of first regions 1064 and a plurality of second regions 1066. The first regions 1064 have a first axis 1068 and a second axis 1069, wherein the first axis 1068 is longer than the second axis 1069. The first axis 1068 is substantially parallel to an axis 1 of the network, and the second axis 1069 is substantially parallel to an axis t of the network. The second regions 1066 have a first axis 1070 and a second axis 1071. The first axis 1070 is substantially parallel to the axis 1 of the network, and the second axis 1071 is substantially parallel to the axis t of the network.

In the embodiment shown in FIG. 3, the first regions 1064 are substantially planar. The second regions 1066 include a plurality of rib like elements 1074. The rib like elements 1074 have a first major axis 1076 which is substantially parallel to the axis t of the network, and a second minor axis 1077 which is substantially parallel to the axis 1 of the network. The rib like elements 1074 extend outward from surrounding portions of the strainable network (toward the viewer in FIG. 3) to form ridges 1072 in the surface 82. Valleys corresponding to the ridges 1072 form depressions in the surface 42. The rib like elements 1074 are shown schematically in FIGS. 1 and 2. Details of the ridges 1072 and the corresponding valleys are not shown in FIGS. 1 and 2.

Referring to FIG. 3, when an elongation (indicated by arrows 1080) is applied to the strainable network generally parallel to axis 1, the rib like elements 1074 are able to unbend or geometrically deform in a direction substantially perpendicular to their first axis 1076, thereby allowing elastic like extension of the strainable network generally parallel to the axis 1.

Figure 2:
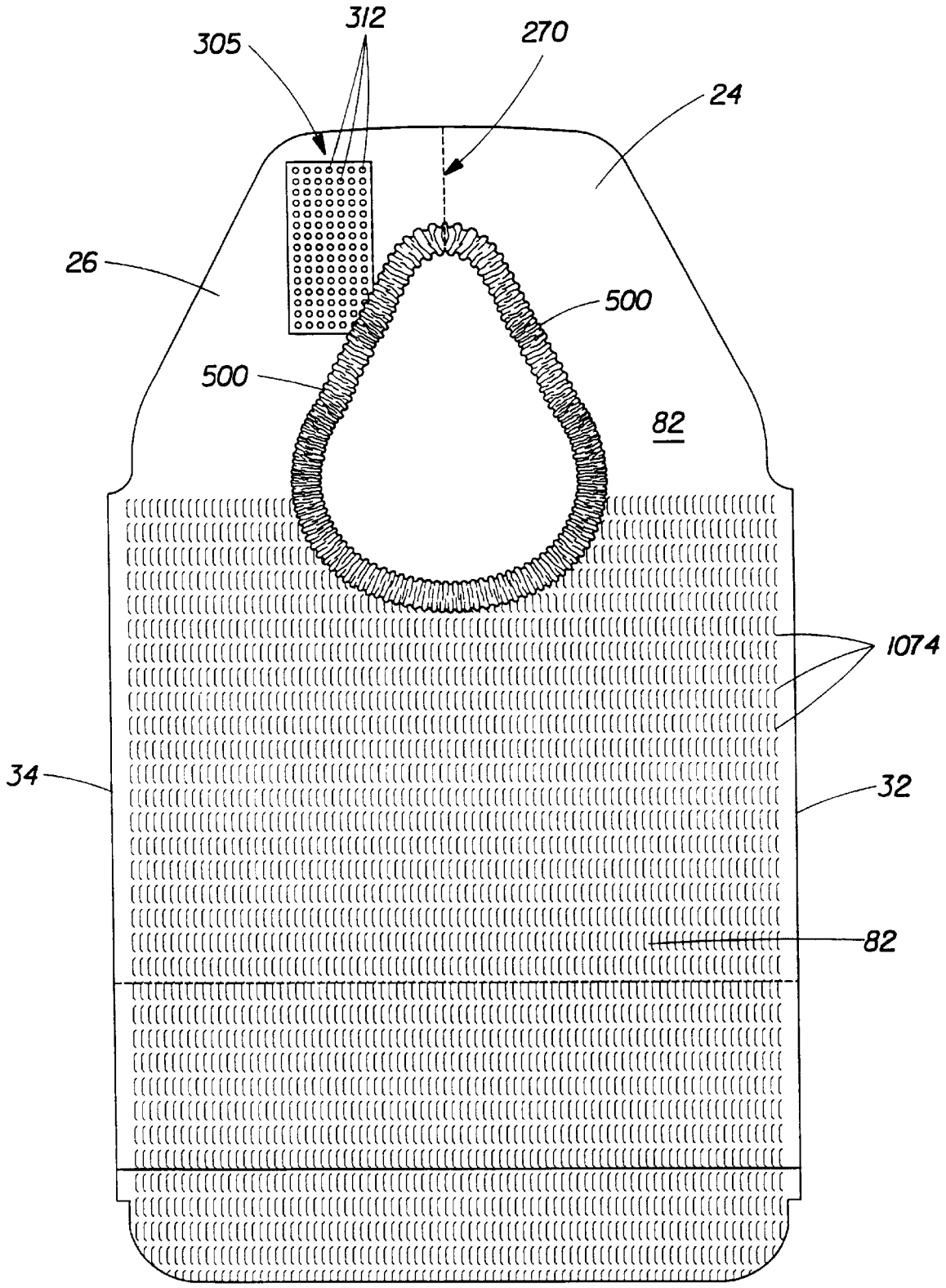
FIG. 2 is a rear plan view of a disposable bib of the present invention.

In FIGS. 1 and 2, the strainable network is shown to substantially cover the bib body panel 70, as well as the apron panel 150. The panel 105, while not visible in FIGS. 1 and 2, can also comprise a strainable network, or alternatively, can be free of the strainable network.

In FIGS. 1 and 2, the strainable network is oriented on the laminate of the layers 40 and 80 such that the axis t of the network is substantially parallel to the longitudinal axis 21 of the bib 20. Accordingly, the strainable network provides elastic like behavior of the laminate of the layers 40 and 80 in at least the lateral direction. Accordingly, the bib 20 can be elastically extended in a direction across the wearer's chest.

In an alternative embodiment, the strainable network can be imparted to the laminate such that the axis 1 of the strainable network is parallel to the longitudinal axis 21 of the bib 20, thereby providing elastic like behavior to the laminate of the layers 40 and 80 in at least a longitudinal direction.

In yet another embodiment, the level of embossment used to form the rib like elements 1074 can be varied. For instance, a strainable network can be imparted to the bib pocket panel 105 at a first level of embossment, and a strainable network can be imparted to the bib body panel 70 at a different level of embossment.

In yet another embodiment, the size or shape of the rib like elements 1074 can be varied. For instance, the size of the rib like elements 1074 as measured along axis 1076 or 1077 on one portion of the bib can be different from the size of the rib like elements 1074 on another portion of the bib. As an example, the size of the rib like elements on the pocket panel 105 can be different from the size of the rib like elements on the body panel 70.

In still another embodiment, a strainable network can be imparted to one or both of the shoulder extensions 24 and 26 to provide elastic like extension of the shoulder extensions.

In other embodiments, one or more strainable networks can be imparted to different portions of the bib to provide elastic like behavior in one or more directions. For instance, one or more strainable networks can be imparted to one or more portions of the bib to provide elastic like behavior in a direction inclined to the longitudinal axis 21.

In yet another embodiment, the strainable network can have one or more regions that extend generally linearly in a direction inclined with respect to the longitudinal axis 21.

Figure 5:
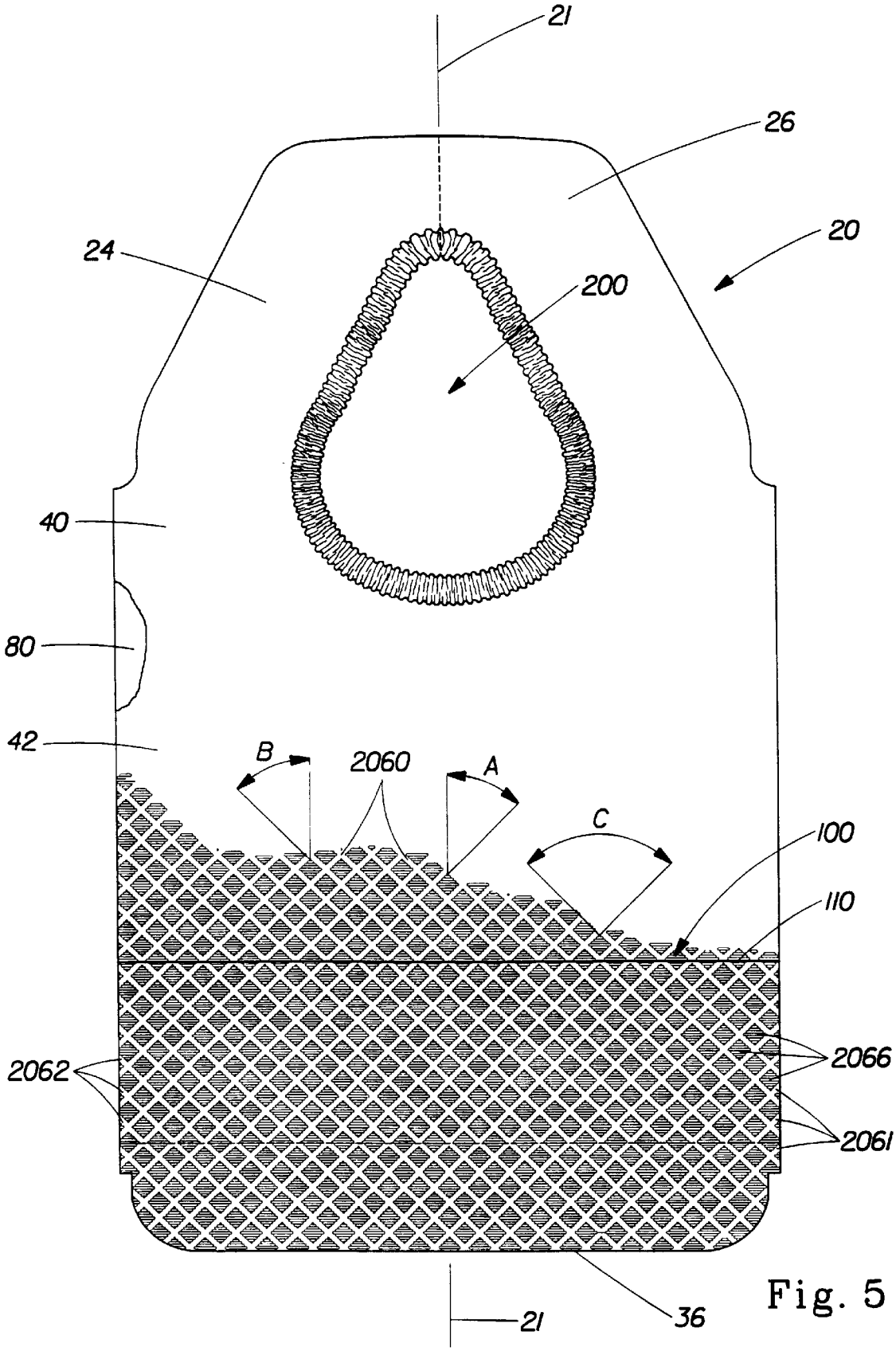
FIG. 5 is a schematic illustration of a front plan view of disposable bib according to an alternative embodiment of the present invention, wherein the disposable bib includes a strainable network having mutually perpendicular, intersecting first regions extending along first and second directions which are inclined at about a 45 degree angle with respect to the longitudinal centerline of the bib, and second regions comprising rib like elements, each rib-like element having a major axis extending perpendicular to the longitudinal centerline of the bib.
Figure 6:
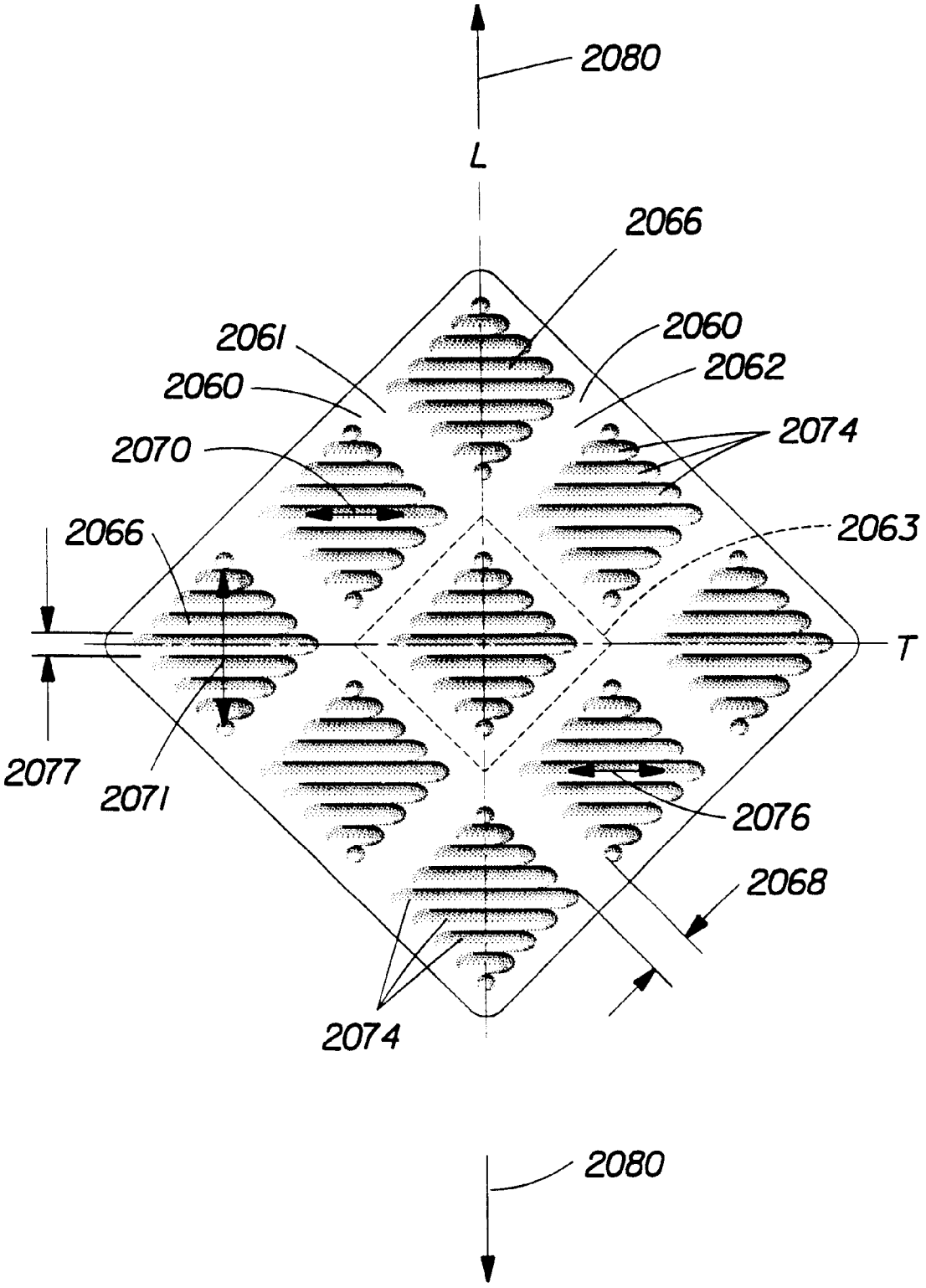
FIG. 6 is enlarged view of a portion of a strainable network of the type illustrated in FIG. 5 showing the first regions forming a boundary completely surrounding the second regions.

Referring to FIGS. 5 and 6, a bib 20 according to an alternative embodiment of the present invention can comprise a strainable network which includes a plurality of first regions, indicated by reference numeral 2060 in FIG. 5, and a plurality of second regions, indicated by reference numeral 2066. A portion of the first regions 2060, indicated generally as 2061, are substantially linear and extend in a first direction. The remaining first regions 2060, indicated generally as 2062, are substantially linear and extend in a second direction which is different from the first direction. The first regions 2060 undergo a molecular level and geometric deformation and the second regions 2066 initially undergo a substantially geometric deformation when the bib is subjected to an applied elongation along at least one axis. Such a strainable network is described generally in commonly assigned U.S. Pat. No. 5,650,214 issued Jul. 22, 1997 in the names of Anderson et al., which patent is incorporated herein by reference.

The first regions 2061 can extend in a first direction which is inclined at an angle A (FIG. 5) with respect to the longitudinal centerline 21. The angle A can be between about 30 degrees and about 60 degrees. The first regions 2062 can extend in a second direction which is inclined at an angle B with respect to the longitudinal centerline 21. The angle B can be between about 30 and about 60 degrees. In the embodiment shown in FIG. 5, the angles A and B can both be about 45 degrees. The angle C between the first and second directions is preferably between about 45 degrees to about 135 degrees.

In the embodiment shown in FIG. 5, the first and second directions are substantially perpendicular to one another. The intersection of the first regions 2061 with the first regions 2062 forms a boundary, indicated by phantom line 2063 in FIG. 6, which completely surrounds the second regions 2066.

For simplicity, the strainable network is shown on only a portion of the bib 20 facing the viewer in FIG. 5. It will be understood that the strainable network can cover some or all of the body panel 70. For instance, the strainable network can extend over a portion of all of the shoulder extensions 24, 26, or alternatively can be omitted from the shoulder extensions 24, 26. Similarly, the strainable network can cover some or all of the pocket panel 105 and the apron panel 150. In one embodiment, the strainable network is omitted from the pocket panel 105 and the portion of the body panel which faces the pocket panel 105.

The strainable network shown in FIG. 6 is viewed from the body facing surface 82 of the bib 20. Referring to FIG. 6, the second regions 2066 include a plurality of raised, rib-like elements 2074. The rib like elements 2074 extend outward from surrounding portions of the strainable network (toward the viewer in FIG. 6) to form ridges in the body facing surface 82. Valleys corresponding to the ridges form depressions in the surface 42.

As shown in FIG. 6, the strainable network has an axis L and a mutually perpendicular axis T. In FIG. 5, the axis L of the strainable network is substantially parallel to the longitudinal centerline 21 of the bib.

The width 2068 of the first regions 2060 can be from about 0.01 inch to about 0.5 inch. In one embodiment, the width 2068 is about 0.030 inch.

The second regions 2066 have a first axis 2070 and a second axis 2071. The first axis 2070 is substantially parallel to the axis T, and the second axis is substantially parallel to the axis L. The rib like elements 2074 may be embossed, debossed, or a combination thereof The rib-like elements have a first or major axis 2076 and a second or minor axis 2077. In FIG. 5, the major axis 2076 of the rib like elements 2074 is substantially perpendicular to the longitudinal centerline 21 of the bib 20.

When the strainable network of the type shown in FIG. 6 is subjected to an applied elongation (indicated by arrows 2080 in FIG. 6) along an axis, the first regions 2061 and 2062 provide most of the initial resistive force as a result of molecular level deformation, while the second regions 2066 are experiencing geometric deformation. In addition, the shape of the second regions 2066 changes as a result of the movement of the reticulated structure formed by intersecting first regions 2061 and 2062. Accordingly, as the strainable network is subjected to the elongation, the first regions 2061 and 2062 experience geometric deformation, thereby changing the shape of the second regions. The second regions 2066 are extended or lengthened in a direction parallel to the direction of the applied elongation, and are foreshortened in a direction perpendicular to the direction of the applied elongation. This characteristic of the strainable network shown in FIG. 6 is described in above referenced U.S. Pat. No. 5,650,214.

Without being limited by theory, it is believed that the strainable network shown in FIGS. 5 and 6 provides elastic like behavior parallel to the bib axis 21, while providing bending flexibility about both lateral and longitudinal axes. The elastic like behavior parallel to the bib axis 21 allows young wearers to tug on the bib without tearing the shoulder extensions 24,26, especially if the strainable network extends at least partially into the shoulder extensions 24, 26.

Additionally, the strainable network shown in FIGS. 5 and 6 is believed to provide the advantage that when the bib is elongated in a direction parallel to the axis 21, the sides 32,34 of the bib tend to curl outward, away from the wearer (toward the viewer in FIG. 5) thereby helping to direct materials spilled or dripped on the surface 42 into the pocket 100.

Figure 7:
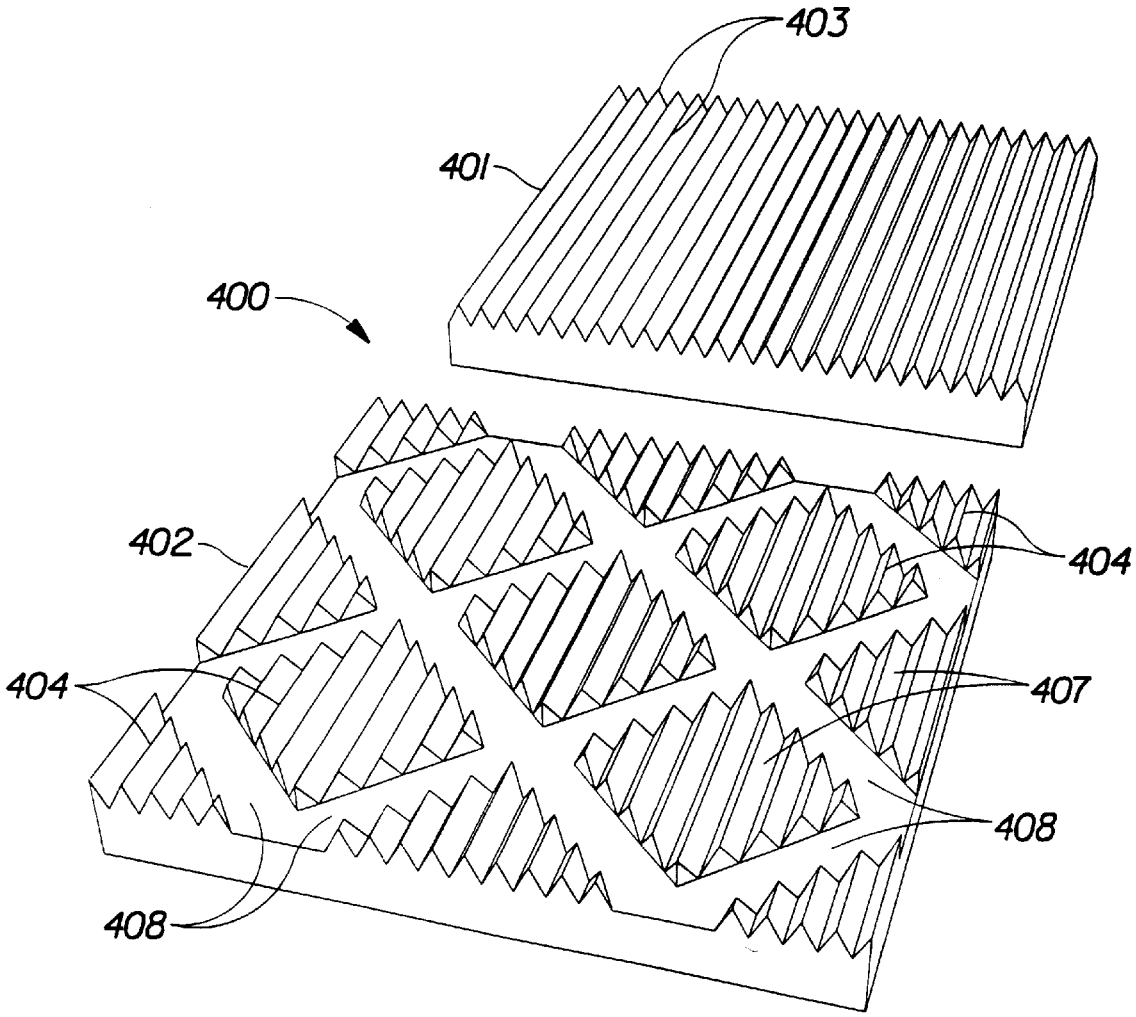
FIG. 7 is a schematic perspective illustration of a toothed apparatus used to form the strainable network shown in FIG. 6.
Figure 8:
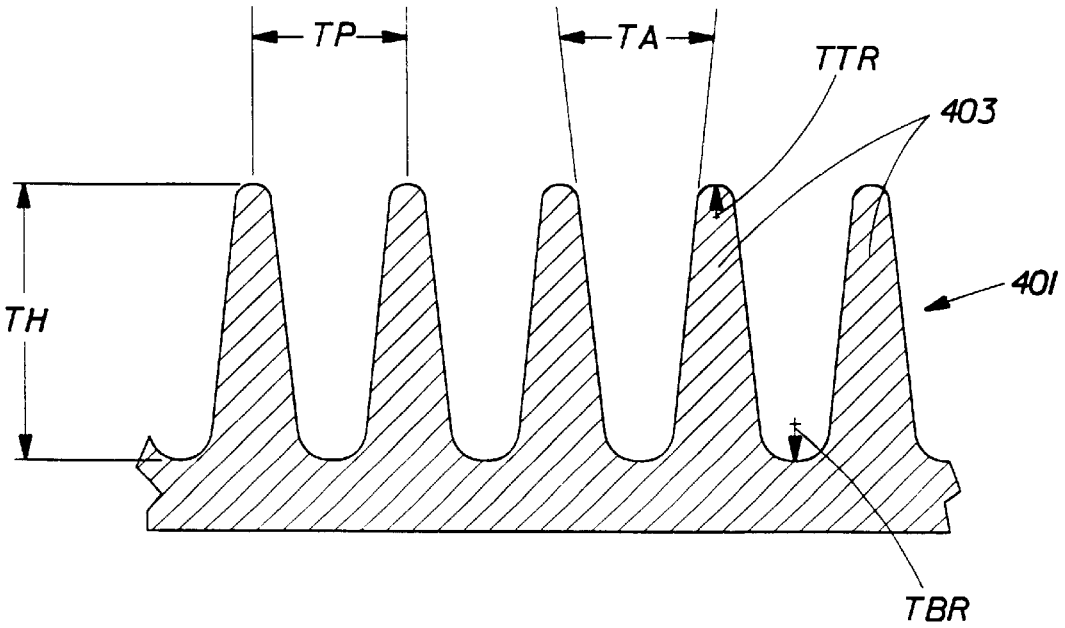
FIG. 8 is a cross-sectional illustration of a portion of the apparatus of FIG. 7.
Figure 9:
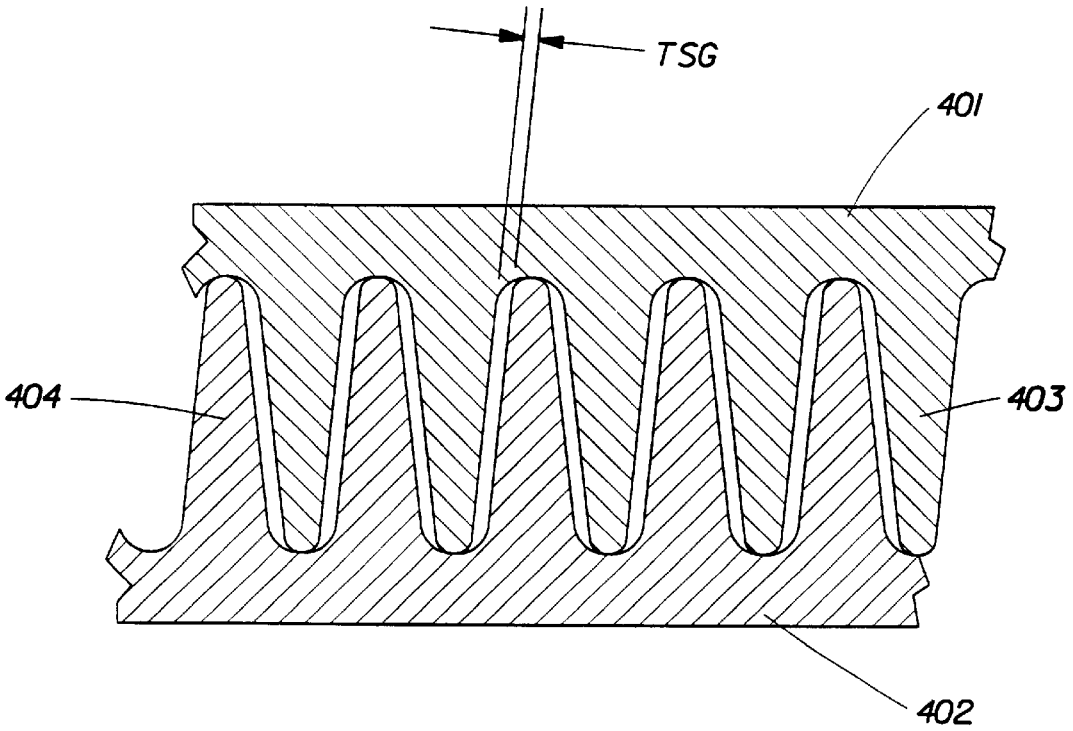
FIG. 9 is a cross-sectional illustration of the apparatus of FIG. 7 showing engagement of the teeth used to form the strainable network.

FIG. 7 shows a toothed apparatus 400 which can be used to permanently elongate portions of the bib and thereby form the strainable network shown in FIG. 6. FIG. 8 is a cross-sectional illustration of a portion of the apparatus of FIG. 7. FIG. 9 is a cross-sectional illustration of the apparatus of FIG. 7 showing engagement of the teeth used to form the strainable network.

Referring to FIG. 7, the apparatus 400 includes intermeshing plates 401 and 402. Plates 401 and 402 include a plurality of intermeshing teeth 403,404, respectively. The strainable network is formed by placing the bib laminate between the plates 401 and 402, and bringing the plates 401,402 together under loading to form the strainable network. Preferably, the paper topsheet 40 is positioned against the plate 402 and the backsheet 80 is positioned against the plate 401.

Plate 402 includes toothed regions 407 and grooved region 408. Within the toothed regions 407 there are a plurality of teeth 404. Plate 401 includes teeth 403 which mesh with teeth 404 of plate 402. When a substrate, such as a laminate of topsheet 40 and backsheet 80, is formed between plates 401, 402, the portions of the substrate which are positioned between grooved regions 408 of plate 402 and teeth 403 on plate 401 remain undeformed. These regions correspond to the first regions 2060. The portions of the substrate positioned between toothed regions 407 of plate 402 and teeth 403 of plate 401 are permanently elongated, creating rib-like elements 2074 in the second regions 2066.

The plate 401 is shown in cross-section in FIG. 8. The teeth 403 (and the teeth 404 on plate 402) can have the following characteristics to form a strainable network in the laminate comprising the paper topsheet 40 and the plastic film backsheet 80: The tooth height TH can be about 0.0800 inch, the tooth pitch TP can be about 0.0400 inch, the tooth angle TA can be about 11.31 degrees, the tooth tip radius TTR can be about 0.0040 inch, and the tooth base radius TBR can be about 0.0093 inch.

FIG. 9 shows intermeshing of the plates 401 and 402 without a substrate positioned between the plates. The plates 401 and 402 can intermesh to have a tooth side gap TSG of about 0.0048 inch, as shown in FIG. 9.

For example, a strainable network of the type shown in FIG. 5 can be imparted to the laminate of the paper topsheet 40 and plastic film backsheet 80 using the following procedure. The laminate comprises a two ply BOUNTY brand paper towel manufactured by The Procter and Gamble Co. joined to a polyethylene film having a thickness of about 0.002 inch. The total thickness of the laminate of the topsheet 40 and backsheet 80 is about 0.020 inch prior to pressing. The laminate is placed between the plates 401 and 402. The laminate is pressed between the plates with a compressive loading to compress the assembly of the plates 401,402 and the laminate about 0.040 inch. The compressive loading is then released, and the laminate having the formed strainable network is removed from between the plates 401, 402. The resulting laminate having the strainable network has a thickness of about 0.050 inch.

In an alternative embodiment, portions of the bib 20 can be ring rolled to provide permanent elongation of portions of the bib and to make portions of the bib relatively extensible. Selected regions of the bib can be ring rolled in accordance with methods described in the following U.S. Patents, which patents are incorporated herein by reference. U.S. Pat. No. 4,107,364 issued to Sasson on Aug. 15, 1978; U.S. Pat. No. 4,834,741 issued to Sabee on May 30, 1989; U.S. Pat. No. 5,143,679 issued to Weber et al. on Sep. 1, 1992; U.S. Pat. No. 5,156,793 issued Oct. 20, 1992 to Buell et al.; and U.S. Pat. No. 5,167,897 issued Dec. 1, 1992 to Weber et al.

Portions of the bib can be ring rolled to provide extensibility to selected portions of the bib, and to provide increased Z-direction bulking and surface texture to the bib in the form of raised peaks and recessed valleys. The peaks and valleys can extend generally parallel to the axis 21 to provide transverse extensibility, generally perpendicular to the axis 21 to provide longitudinal extensibility, or the peaks and valleys can be inclined with respect to the longitudinal and transverse directions of the bib. For instance, for a bib having shoulder extensions (or otherwise having neck fastening straps), the shoulder extensions can be ring rolled to provide extensibility of the shoulder extensions parallel to the axis 21 of the bib. The shoulder extensions can then be extended at the point of use of the bib by pulling on the distal end of the shoulder extension.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A disposable bib having a longitudinal centerline, a lateral width, and longitudinally extending side edges; wherein at least a portion of the bib is permanently elongated to provide improved extensibility of the portion of the bib.

2. The disposable bib of claim 1 wherein selected portions of the bib are permanently elongated.

3. The disposable bib of claim 1 wherein portions of the bib are permanently elongated to provide Z-direction bulking of the bib.

4. The disposable bib of claim 1 wherein at least a portion of the bib includes a strainable network comprising a first region and a second region, the first region undergoing a substantially molecular level deformation and the second region initially undergoing a substantially geometric deformation when the bib is subjected to an applied elongation along at least one axis.

5. The disposable bib of claim 4 wherein the bib comprises a laminate of at least a first layer and a second layer, and wherein at least a portion of the laminate comprises the strainable network.

6. The disposable bib of claim 5 wherein the second region includes a plurality of raised rib-like elements.

7. The disposable bib of claim 6 wherein the laminate comprises a second body facing layer, and wherein the raised rib-like elements extend outwardly from the body facing surface.

8. The disposable bib of claim 5 wherein the laminate comprises a first paper layer and a second liquid impervious film layer.

9. The disposable bib of claim 5 wherein the strainable network is oriented to provide elastic like behavior of the laminate in a lateral direction.

10. The disposable bib of claim 5 wherein the strainable network is oriented to provide elastic like behavior of the laminate along the longitudinal axis of the bib.

11. The disposable bib of claim 4 wherein the bib comprises a pocket, and wherein at least a portion of the pocket comprises a strainable network.

12. The disposable bib of claim 11 wherein the bib comprises a pocket panel and an apron panel, and wherein at least a portion of the apron panel comprises a strainable network.

13. A disposable bib having a longitudinal centerline, a lateral width, and longitudinally extending side edges, wherein at least a portion of the bib comprises a strainable network; the strainable network comprising a plurality of intersecting first regions surrounding a plurality of second regions; wherein the second regions comprise a plurality of raised rib-like elements, the first regions undergoing a molecular level and geometric deformation and the second regions initially undergoing a substantially geometric deformation when the bib is subjected to an applied elongation along at least one axis.

14. The disposable bib of claim 13 wherein a portion of the first regions extend in a first direction and wherein another portion of the first regions extend in a second direction different from the first direction, and wherein the first and second directions are inclined relative to the longitudinal centerline of the bib.

15. The disposable bib of claim 14 wherein the first regions extend in first and second directions inclined at an angle of between about 30 degrees and about 60 degrees relative to the longitudinal centerline of the bib.

16. The disposable bib of claim 15 wherein at least some of the rib-like elements of the second regions have a major axis and a minor axis, and wherein the major axis extends substantially perpendicular to the longitudinal centerline of the bib.

17. The disposable bib of claim 13 wherein the bib comprising a laminate of at least a first layer and a second layer, and wherein at least a portion of the laminate comprises the strainable network.

18. The disposable bib of claim 17 wherein the laminate comprises a first absorbent layer and a second water impervious film layer.

19. The disposable bib of claim 18 wherein the laminate comprises a first paper layer and a second film layer.

20. The disposable bib of claim 19 wherein the laminate comprises a polymeric film.

21. The disposable bib of claim 20 wherein the polymeric film is comprised of polyethylene.

22. A disposable bib having a longitudinal centerline, a lateral width, and longitudinally extending side edges, the bib comprising a laminate of at least a first layer and a second layer; wherein at least a portion of the laminate comprises a strainable network; the strainable network comprising a plurality of first regions and a plurality of second regions being comprised of the same material composition; a portion of the first regions extending in a first direction while the remainder of the first regions extend in a second direction different from the first direction to intersect one another, the first regions forming a boundary completely surrounding the second regions;

and wherein the second regions comprise a plurality of raised rib-like elements, the first regions undergoing a molecular level and geometric deformation and the second regions initially undergoing a substantially geometric deformation when the laminate is subjected to an applied elongation along at least one axis.

23. The disposable bib of claim 22 wherein the first regions and the second regions are visually distinct from one another.

24. The disposable bib of claim 23 wherein the first and second directions are inclined relative to the longitudinal centerline of the bib.

25. The disposable bib of claim 24 wherein the first and second directions are inclined at an angle of between about 30 degrees and about 60 degrees relative to the longitudinal centerline of the bib.

26. The disposable bib of claim 24 wherein at least some of the rib-like elements of the second region have a major axis and a minor axis, and wherein the major axis extends substantially perpendicular to the longitudinal centerline of the bib.

* * * * *